US010736438B1

(12) United States Patent
Jhaveri

(10) Patent No.: US 10,736,438 B1
(45) Date of Patent: Aug. 11, 2020

(54) DISPLAY SHELF LOCK BOX

(71) Applicant: Ansh B. Jhaveri, Irving, TX (US)

(72) Inventor: Ansh B. Jhaveri, Irving, TX (US)

(73) Assignee: VIRA Insight, LLC., Coppell, TX (US)

( * ) Notice: Subject to any disclaimer, the term of this patent is extended or adjusted under 35 U.S.C. 154(b) by 0 days.

(21) Appl. No.: 16/788,883

(22) Filed: Feb. 12, 2020

(51) Int. Cl.

| | |
|---|---|
| ***A47F 3/00*** | (2006.01) |
| ***E05D 7/00*** | (2006.01) |
| ***A47F 5/00*** | (2006.01) |
| ***E05D 1/04*** | (2006.01) |

(52) U.S. Cl.
CPC ..... *A47F 3/002* (2013.01); *A47F 5/0025* (2013.01); *E05D 1/04* (2013.01); *E05D 7/009* (2013.01); *E05Y 2900/602* (2013.01)

(58) Field of Classification Search
CPC ..... A47F 3/002; A47F 5/0025; A47F 7/03; E05D 7/009; E05D 1/04; E05Y 2900/602
USPC ..... 220/539, 540, 54, 203.22; 70/63, 14
See application file for complete search history.

(56) References Cited

U.S. PATENT DOCUMENTS 216,229 A * 6/1879 Sherriff ..... A45C 13/02 190/36
872,837 A * 12/1907 Mio ..... A21B 3/13 249/157
958,857 A * 5/1910 Dennis ..... A47J 47/20 220/8
2,578,644 A * 12/1951 Mautner ..... B65D 7/12 217/65
2,920,781 A * 1/1960 Weber ..... B65D 88/528 217/12 R
3,140,777 A * 7/1964 Gordan ..... A45C 11/24 206/315.1
3,463,343 A * 8/1969 Asenbauer ..... B65D 21/086 220/8
3,517,853 A * 6/1970 Aikens ..... F21V 15/01 220/324
3,572,535 A * 3/1971 Kinzie ..... B65D 9/22 220/4.33

(Continued)

OTHER PUBLICATIONS

Submitted photographic file: baby_formula_display.pdf; showing retail display of cannisters of baby formula behind adjustable height locked doors.

(Continued)

*Primary Examiner* — Jonathan Liu
*Assistant Examiner* — Devin K Barnett
(74) *Attorney, Agent, or Firm* — Dan Brown Law Office; Daniel R. Brown

(57) ABSTRACT

A lock box useful to secure products in a display shelving system. The lock box is configured with first, second, third, and fourth quadrantal sub-frames that are combined into a rectangular frame unit. Each of the quadrantal sub-frames includes corresponding left-face and right-face quarter-panels, which adjustably and overlappingly and engage one another to form corresponding left and right sidewalls, which enables selectable adjustment of the height and depth of the frame unit. A hinge coupled along the front face of the frame unit, and a door that comprises an adjustable height first and second portion engages the hinge. A lock mechanism is disposed between the door and the frame unit to secure the door in a closed position.

16 Claims, 12 Drawing Sheets

(56) References Cited

U.S. PATENT DOCUMENTS 3,858,495 A * 1/1975 Gotwalt ..... A47J 37/0694 99/421 HH
3,887,102 A * 6/1975 Earley ..... F25D 25/022 220/8
3,935,959 A * 2/1976 Long ..... A24B 1/08 220/529
3,966,285 A * 6/1976 Porch ..... B65D 7/24 312/265.4
4,098,424 A * 7/1978 Liebscher ..... B65D 88/14 220/1.5
4,216,927 A * 8/1980 Byrd ..... B64D 9/00 220/1.5
D265,867 S * 8/1982 Margulis ..... D3/294
4,682,825 A * 7/1987 Crosslen ..... A47F 3/002 211/59.2
5,016,772 A * 5/1991 Wilk ..... B65D 21/086 220/495.01
5,192,019 A * 3/1993 Meehan ..... B65D 5/0005 220/8
5,340,308 A * 8/1994 Cukjati ..... A61C 9/0006 433/1
5,386,788 A * 2/1995 Linker ..... E05G 1/024 109/58
5,388,714 A * 2/1995 Zutler ..... A61L 9/12 220/360
5,638,707 A * 6/1997 Gould ..... E05B 67/38 40/649
5,762,222 A * 6/1998 Liu ..... B65D 19/12 206/512
6,095,624 A * 8/2000 Wilbert ..... G07B 3/04 312/293.3
6,116,452 A * 9/2000 Hamel ..... A61L 2/26 206/370
6,691,884 B1 * 2/2004 Dwyer ..... F25D 3/08 220/4.03
6,701,678 B1 * 3/2004 Skov ..... A47F 5/0815 403/326
6,976,919 B2 * 12/2005 Cole ..... G07F 17/32 194/206
7,150,365 B2 12/2006 Hardy et al.
D539,633 S * 4/2007 Van Handel ..... D8/333
7,299,934 B2 11/2007 Hardy et al.
7,316,319 B2 * 1/2008 West ..... B65D 5/68 108/51.3
7,451,881 B2 11/2008 Hardy et al.
7,464,827 B2 * 12/2008 Meissen ..... B65D 21/0212 206/557
7,565,999 B1 * 7/2009 Jensen ..... G07F 17/42 220/210
7,621,409 B2 11/2009 Hardy et al.
7,641,072 B1 * 1/2010 Vlastakis ..... A47F 1/126 221/123
7,661,545 B2 2/2010 Hardy et al.
7,975,865 B2 * 7/2011 Marcel ..... B65D 90/008 206/512
8,047,385 B2 11/2011 Hardy
8,113,601 B2 2/2012 Hardy
8,117,973 B1 * 2/2012 Frank ..... E05G 1/005 109/47
8,136,682 B2 3/2012 Hardy
8,210,363 B2 * 7/2012 Hardy ..... A47F 1/126 211/59.3
8,235,227 B2 * 8/2012 Hardy ..... A47F 1/12 211/59.3
8,785,773 B1 * 7/2014 Lanni ..... H02G 3/14 174/53
8,820,860 B2 * 9/2014 Ruiz ..... E05B 17/2088 292/194
D772,522 S * 11/2016 Henderson ..... D99/28
9,624,000 B1 * 4/2017 McLaughlin ..... A47D 15/00
9,687,085 B2 6/2017 Hardy
9,884,702 B1 * 2/2018 Burns ..... B65D 21/086
9,938,061 B2 * 4/2018 Garthe ..... E05G 1/005
2006/0162403 A1 * 7/2006 Handel ..... A47G 29/10 70/63
2006/0191209 A1 * 8/2006 Reisman ..... E04H 1/1205 52/36.2
2006/0226143 A1 * 10/2006 Elstone, Sr. ..... B65D 19/12 220/6
2008/0283477 A1 * 11/2008 Wamsley ..... A47F 3/002 211/4
2010/0147853 A1 * 6/2010 Hackett ..... E05B 67/383 220/315
2010/0228666 A1 * 9/2010 Laskowski ..... G06Q 20/10 705/39
2011/0062834 A1 * 3/2011 Ball ..... E05C 3/042 312/215
2012/0138607 A1 * 6/2012 Mattox ..... B65D 21/086 220/8
2013/0341258 A1 * 12/2013 Sekora ..... A47J 37/1295 210/167.28
2015/0001168 A1 * 1/2015 Busby ..... A47B 47/0075 211/59.2
2015/0353232 A1 * 12/2015 Kandel ..... A47G 23/06 220/574
2016/0123701 A1 * 5/2016 Ho ..... E05B 65/52 70/63
2016/0186465 A1 * 6/2016 Nelson ..... B65D 55/14 220/210
2017/0113856 A1 * 4/2017 Hollis ..... B65D 43/20
2017/0234341 A1 * 8/2017 Packman ..... A47C 19/005 312/108
2019/0061142 A1 * 2/2019 Kitowski ..... B25H 3/06
2019/0159620 A1 * 5/2019 Veon ..... A47G 29/141
2019/0382174 A1 * 12/2019 Enger ..... B65D 25/20
2020/0048951 A1 * 2/2020 Herschap ..... G06Q 10/0833

OTHER PUBLICATIONS

Submitted photographic file: CPAP_sanitizer case.pdf; showing retail display of CPAP sanitizers behind sliding door locked case.
Submitted photographic file: electric_shaver_case.pdf; showing retail display case of electric razors behind sliding doors.
Submitted photographic file: shaving_supply_case.pdf; showing retail display case of shaving supplies behind sliding doors.
Submitted photographic file: teeth_whiteners.pdf; showing secure cases of teeth whiteners on a retail shelf.
Submitted photographic file: razor_bldeas.pdf; showing secure cases of razor blades behind locked doors.

* cited by examiner

2

DISPLAY SHELF LOCK BOX

RELATED APPLICATIONS

None.

BACKGROUND OF THE INVENTION

Field of the Invention

The present disclosure generally relates to retail shelving lock boxes. More particularly, the present disclosure relates to retail shelving security lock boxes that are adjustable in size.

Description of Related Art

Retail shelving units come in a variety of configurations for a variety of purposes. Commonly employed shelving systems may be configured as gondola shelve that include a self supporting structure with back-to-back shelves, or as an end cap shelf that may terminate the end of a row of gondola shelves, or as a wall unit that is essentially one-half of a gondola unit placed against a wall or other object. These configurations are well known to those skilled in the art of retail shelving systems. Of course, there are a myriad of shelving and display fixtures utilized in retail sales, and it is to be understood that the teachings of this disclosure are applicable to virtually all of them. All of these arrangements provide a vertical stack of shelves, one above the other, supported on a frame assembly. Products are place upon and displayed by the shelving systems.

When retail shelving systems, having a myriad of products displayed thereon, are presented for public access by consumers, there exists a risk of theft and loss. This risk increases with the value of the retail goods displayed, and with the relative size of those goods, where smaller, high-value, goods typically experience a higher risk of loss. One particularly egregious form of loss is referred to a "sweeping", where a thief sweeps a shelf full of products into a container of some sort and then flees the retail establishment, resulting in a substantial loss. Thus, there is a need in the art to secure retail products while still employing conventional shelving systems, which shelving come in a variety of sizes, depths, and shelf spacing arrangements, while still displaying them for perusal by customers, and while providing controlled access for retrieval and purchase by customers.

SUMMARY OF THE INVENTION

The present disclosure teaches a lock box useful to secure products in a display shelving system that includes shelf surfaces. The lock box is configured with first, second, third, and fourth quadrantal sub-frames that are combined into a frame unit, which has a rectangular cuboidal form, defining front and rear faces, top and bottom faces, and left and right faces. Each of the first, second, third, and fourth quadrantal sub-frames includes corresponding first, second, third, and fourth left-face quarter-panels, and corresponding first, second, third, and fourth right-face quarter-panels, which quarter-panels adjustably and overlappingly engage one another to form corresponding left and right sidewalls along the the left and right faces of the frame unit, and which enable selectable adjustment of the height and depth of the frame unit. The lock box also includes a hinge coupled along the front face of the frame unit, and a door that comprises a first and second portion. The first portion engages the hinge, and the second portion adjustably and overlappingly engages the first portion to enable adjustment of the door size to fit the front-face of the frame unit. A lock mechanism is disposed between the door and the frame unit to secure the door in a closed position. The frame unit includes an attachment member that secures the frame unit to a shelf surface.

In a specific embodiment of the foregoing lock box, where the bottom face of the frame unit is open, the attachment member secures the frame unit in place such that the shelf surface encloses the bottom face of the frame unit.

In a specific embodiment of the foregoing lock box, where the display shelving system includes a back wall surface adjacent the shelf surface, and where the rear face of the frame unit is open, the attachment member secures the frame unit in place such that the back wall surface encloses the rear face of the frame unit.

In a specific embodiment of the foregoing lock box, where the display shelving system includes a second shelf surface located above the first shelf surface, and where the top face of the frame unit is open, the attachment member secures the frame unit in place such that the second shelf surface encloses the top face of the frame unit.

In a specific embodiment of the foregoing lock box, where the display shelving system includes a second shelf surface located above the first shelf surface, the lock box further includes a second attachment member that secures the frame unit to the second shelf surface.

In a specific embodiment of the foregoing lock box, at least a first one of the first, second, third, and fourth left-face quarter-panels includes a first vertical column of fasteners, and at least a second one of the first, second, third, and fourth left-face quarter-panels includes at least a first fastener aligned to selectively engage one of the first vertical column of fasteners, thereby enabling adjustment of the height of the frame unit. And, at least a first one of the first, second, third, and fourth right-face quarter-panels includes a second vertical column of fasteners, and at least a second one of the first, second, third, and fourth right-face quarter-panels includes at least a second fastener aligned to selectively engage one of the second vertical column of fasteners, thereby enabling adjustment of the height of the frame unit. In a refinement to this embodiment, the first vertical column of fasteners and the a second vertical column of fasteners are first and second columns of holes formed through corresponding ones of the first, second, third, and fourth left-face quarter-panels and right-face quarter-panels, respectively, and the first fastener and the second fastener are first and second holes formed through corresponding ones of the first, second, third, and fourth left-face quarter-panels and right-face quarter-panels, respectively, and the lock box further includes a first and second through-hole fastener selectively disposed between the first and second columns of holes and the first and second holes.

In a specific embodiment of the foregoing lock box, at least a first one of the first, second, third, and fourth left-face quarter-panels includes a first horizontal row of fasteners, and at least a second one of the first, second, third, and fourth left-face quarter-panels includes at least a first fastener aligned to selectively engage one of the first horizontal row of fasteners, thereby enabling adjustment of the depth of the frame unit, and at least a first one of the first, second, third, and fourth right-face quarter-panels includes a second horizontal row fasteners, and at least a second one of the first, second, third, and fourth right-face quarter-panels includes at least a second fastener aligned to selectively engage one of the second horizontal row of fasteners, thereby enabling adjustment of the depth of the frame unit. In a refinement to this embodiment, the first horizontal row of fasteners and the a second horizontal row of fasteners are first and second rows of holes formed through corresponding ones of the first, second, third, and fourth left-face quarter-panels and right-face quarter-panels, respectively, and the first fastener and the second fastener are first and second holes formed through corresponding ones of the first, second, third, and fourth left-face quarter-panels and right-face quarter-panels, respectively, and the lock box further includes a first and second through-hole fastener selectively disposed between the first and second rows of holes and the first and second holes.

In a specific embodiment of the foregoing lock box, a first one of the first portion and the second portion of the door includes a vertical column of fasteners, and a second one of the first portion and the second portion of the door includes a fastener aligned to selectively engage one of the vertical column of fasteners, thereby enabling adjustment of the height of the door. In a refinement to this embodiment, the vertical column of fasteners is a column of holes formed through the first portion of the door, and the fastener in the second portion of the door is a threaded insert fixed to the second portion and a screw engaged therewith, which also passes through a selected one of the column of holes.

In a specific embodiment of the foregoing lock box, the lock mechanism is fixed to the second portion of the door, where the lock selectively engages the frame unit, to secure the door in the closed position.

In a specific embodiment of the foregoing lock box, the hinge includes a row of J-shaped tangs extending from the frame unit adjacent the front face, and the first portion of the door includes a row of slots that correspondingly engage the row of J-shaped tangs to facilitate hinged movement of the first portion of the door with respect to the frame unit.

In a specific embodiment of the foregoing lock box, the first, second, third, and fourth quadrantal sub-frames includes telescopically cooperative frame tubing members positioned adjacent the first, second, third, and fourth left-face quarter-panels, and the first, second, third, and fourth right-face quarter-panels, to facilitate the selectable adjustment of the height and depth of the frame unit.

In a specific embodiment of the foregoing lock box, the first shelf unit is perforated with a predetermined array of holes, and the first attachment member is an angle bracket attached to the frame unit, which has an array of holes formed therethrough and that are arranged to comport with the predetermined array of holes for securing the frame unit to the first shelf surface with threaded fasteners. In another embodiment, where the second shelf unit is perforated with a second predetermined array of holes, the second attachment member is a second angle bracket attached to the frame unit, which has a second array of holes formed therethrough that are arranged to comport with the second predetermined array of holes for securing the frame unit to the second shelf surface with threaded fasteners.

DESCRIPTION OF THE INVENTION

Figure 1:
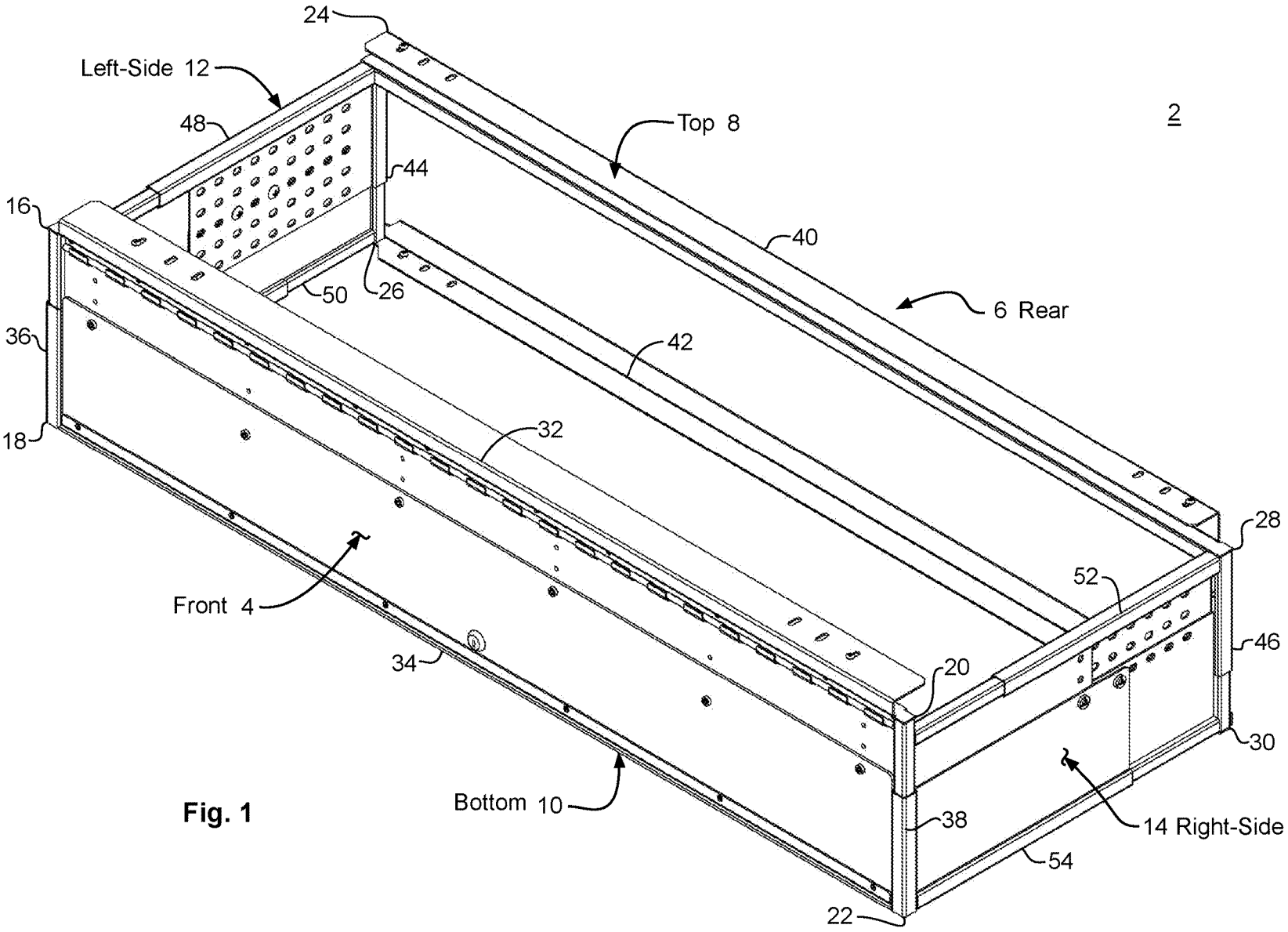
FIG. 1 is an isometric view drawing of a display shelf lock box according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope hereof and additional fields in which the present invention would be of significant utility.

In considering the detailed embodiments of the present invention, it will be observed that the present invention resides primarily in combinations of steps to accomplish various methods or components to form various apparatus and systems. Accordingly, the apparatus and system components, and method steps, have been represented where appropriate by conventional symbols in the drawings, showing only those specific details that are pertinent to understanding the present invention so as not to obscure the disclosure with details that will be readily apparent to those of ordinary skill in the art having the benefit of the disclosures contained herein.

In this disclosure, relational terms such as first and second, top and bottom, upper and lower, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a" does not, without more constraints, preclude the existence of additional identical elements in the process, method, article, or apparatus that comprises the element.

Figure 2:
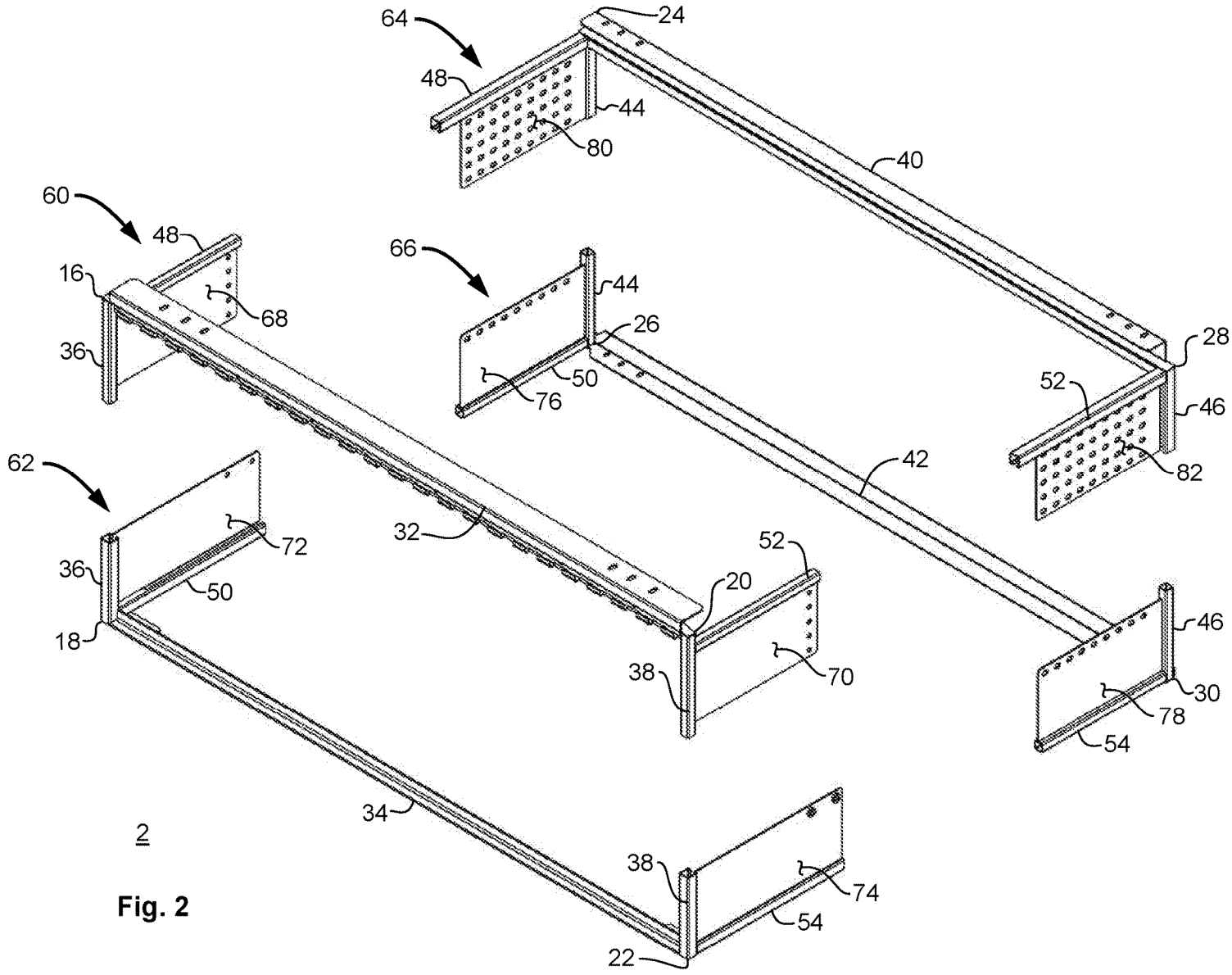
FIG. 2 is an exploded isometric view drawing of a display shelf lock box showing four quadrantal sub-frames according to an illustrative embodiment of the present invention.

Reference is directed to FIG. 1, which is an isometric view of a display shelf lock box 2 according to an illustrative embodiment of the present invention. In order to provide a succinct teaching within the present disclosure, FIG. 1 and FIG. 2 are presented to set forth the geometric arrangement and characteristics of the display shelf lock box 2. Further specific detailed teachings of the various elements employed to enable those skilled in the art to make and use the presently disclosed invention will be further detailed with references to these and the remaining drawing figures, as well as this written description. The display shelf lock box 2 is formed as a rectangular cuboidal frame, comprised of four quadrantal sub-frames (discussed hereinafter), which when assembled together geometrically define six faces, eight vertices, and twelve edges. Now referencing FIG. 1, the six faces include a front face 4, a rear face 6, a top face 8, a bottom face 10, a left-side face 12, and a right-side face 14. Note that in the assembled versions of the illustrative embodiments, some of these faces are open and uncovered, and that use of the word "face(s)" is intended to references the geometric planes of the cuboidal frame arrangement. The eight geometric vertices include a front-top-left vertex 16, a front-bottom-left vertex 18, a front-top-right vertex 20, a front-bottom-right vertex 22, a rear-top-left vertex 24, a rear-bottom-left vertex 26, a rear-top-right vertex 28, and a rear-bottom-right vertex 30. The twelve geometric edges include a front-top edge 32, a front-bottom edge 34, a front-left edge 36, a front-right edge 38, a rear-top edge 40, a rear-bottom edge 42, a rear-left edge 44, a rear-right edge 46, a top-left edge 48, a bottom-left edge 50, a top-right edge 52, and a bottom-right edge 54.

The aforementioned four quadrantal sub-frames are identified in FIG. 2, which corresponds with FIG. 1. In FIG. 2, the four quadrantal sub-frames include a front-top quadrant 60, a front-bottom quadrant 62, a rear-top quadrant 64, and a rear-bottom quadrant 66, which are assembled together to form the rectangular cuboidal frame 2. The four quadrantal sub-frames 60, 62, 64, and 66 are joined together to form the assembled rectangular cuboidal frame 2. The constituent geometric portions of the four quadrantal sub-frames 60, 62, 64, and 66, are as follows. The front-top quadrant frame 60 includes the front-top-left vertex 16 joined with the front-top-right vertex 20 by the front-top edge 32, and includes portions of the front-left edge 36 and top-left edge 48, which support a first-left quarter-panel 68, and includes portion of the front-right edge 38 and the top-right edge 52, which support a first-right quarter-panel 70. The front-bottom quadrant 62 includes the front-bottom-left vertex 18 joined with the front-bottom-right vertex 22 by the front bottom edge 34, and includes portions of the front-left edge 36 and the bottom-left edge 50, which support a second-left quarter-panel 72, and includes portion of the front-right edge 38 and the bottom-right edge 54, which support a second-right quarter-panel 74. The rear-top quadrant 64 includes the rear-top-left vertex 24 joined with the rear-top-right vertex 28 by the rear-top edge 40, and includes portions of the top-left edge 48 and rear-left edge 44, which support a third-left quarter-panel 80, and includes portion of the rear-right edge 46 and the top-right edge 52, which support a third-right quarter-panel 82. The rear-bottom quadrant 66 includes the rear-bottom-left vertex 26 joined with the rear-bottom-right vertex 30 by the rear-bottom edge 42, and includes portions of the bottom-left edge 50 and rear-left edge 44, which support a fourth-left quarter-panel 76, and includes portion of the rear-right edge 46 and the bottom-right edge 54, which support a fourth-right quarter-panel 78.

The four quadrantal sub-frames 60, 62, 64, and 66 are joined such that the several left quarter-panels 68, 80, 72, and 76 come together in overlapping arrangement to define the left-side 12 (FIG. 1). And, the the several right quarter-panels 70, 82, 74, and 78 come together in overlapping arrangement to define the right-side 14 (FIG. 1).

Note that the use of words front, rear, top, bottom, left, and right are used solely to distinguish one entity or relative direction from another entity or relative direction without necessarily requiring or implying any actual relationship or order between such entities or directions as compared to the environment in which the illustrative embodiment may be oriented. For example, the top surface 8 might be oriented as the bottom surface, or one of the side surfaces, when the illustrative embodiment display shelf lock box 2 is actually installed within a display shelf (not shown).

Figure 4:
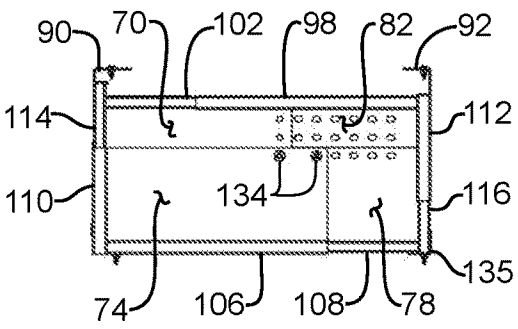
FIG. 4 is a right side view drawing of a display shelf lock box according to an illustrative embodiment of the present invention.
Figure 5:
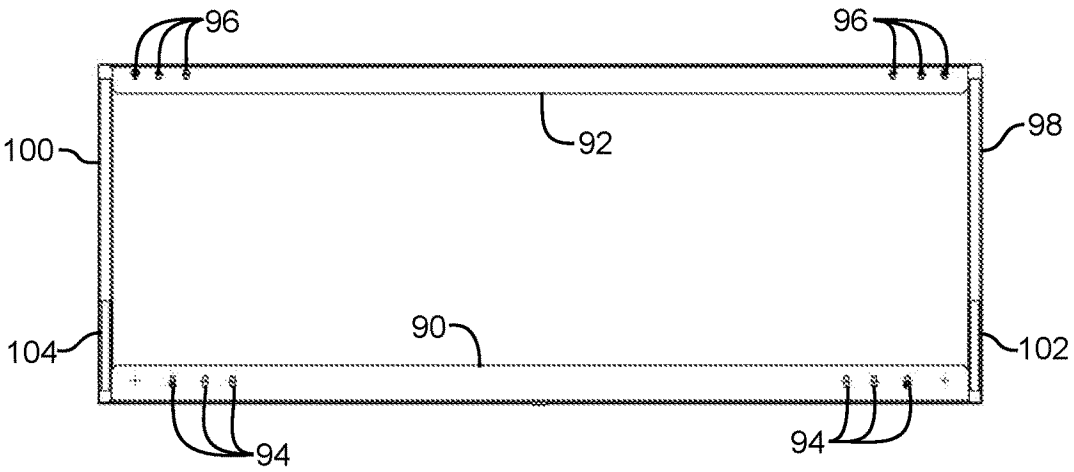
FIG. 5 is a top view drawing of a display shelf lock box according to an illustrative embodiment of the present invention.
Figure 3:
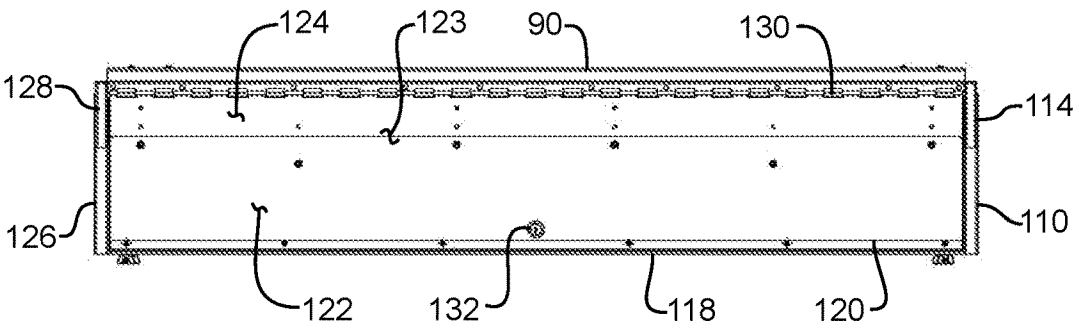
FIG. 3 is a front view drawing of a display shelf lock box according to an illustrative embodiment of the present invention.

Reference is directed to FIG. 3, FIG. 4, and FIG. 5, which are a front view drawing, a right-side view drawing, and a top view drawing, respectively, of a display shelf lock box 2 according to an illustrative embodiment of the present invention. As mentioned hereinbefore, the size of the lock box 2 is adjustable, both in depth (distance between the front and rear), and height (distance between top and bottom), by virtue of the overlapping side panels (discussed in detail hereinafter). In FIGS. 3, 4 and 5, the size of the lock box 2 is illustrated midway between the largest and smallest of these variable distances. During utilization, the lock box 2 is placed on a shelf, such as a gondola shelf (not shown), with the front facing outwardly (FIG. 3) for customer viewing and access. In this illustrative embodiment, the front is closed by a door 123 that includes two clear plastic door portions 122, 124, which are supported by a hinge 130, and secured in a closed position by a lock 132. The top, back, and bottom of the lock box 2 are open, with no cover panels. When deployed on a shelving unit (not shown), a first shelf that the lock box 2 is resting upon encloses the bottom, and a second shelf (not shown) directly above the first shelf it is resting upon encloses the top, and, the rear of the lock box 2 is enclosed by the back wall (not shown) of the shelving unit (not shown).

The frame structure of lock box 2 in FIGS. 3, 4, and 5 is comprised of plural metal framing members, which are rectangular or square steel tubing or bent steel plate members in the illustrative embodiment. The use of aluminum is also contemplated. Other structural materials could also be employed, such as other metals, plastics, and composite materials. Some of the structural members are visible in these figures. Now considering FIG. 3, the front of the lock box 2 is framed by a front-bottom horizontal tube member 118, a top horizontal bent plate member 90, which also serves as a front-top attachment member. The left-side is framed by telescopic rectangular tube members 126 and 128. Similarly, the right-side is framed by telescopic rectangular tube members 110 and 114. A hinge member 130 spans the width of the front-top and hingedly engages the upper portion 124 of the door 123. The bottom edge of the door 123 is framed by steel reinforcing member 120, which strengthens the plastic lower portion 122 of the door 123 against prying.

Now considering the right-side view in FIG. 4, further structural members and side panel members are visible. At the top of the lock box 2 are a front attachment member 90 and a rear attachment member 92, which are both metal bent-plate members, and which are attached to an upper shelf (not shown) when installed in a shelving system (not shown). At the rear bottom of the lock box 2 is a rear-bottom cross member 135, which is also a metal bent-plate member. The height of the lock box 2 is adjustable by virtue of front telescopic tubes 114 and 110, as well as rear telescopic tubes 112, 116. The depth of the lock box 2 is adjustable by virtue of top telescopic tubes 98, 102, and bottom telescopic tubes 106, 108. The right face of the lock box 2 is covered and enclosed by four right-face quarter-panels 70, 74, 78, and 82, which overlappingly engage one another, and which are fixed in position using secure fasteners 134. This arrangement will be more fully described hereinafter. Secure fastener means any of those fasteners that cannot be readily disassembled by hand or with commonly available tools, as are known to those skilled in the art.

The top view in FIG. 5 reveals further details on the front-top attachment member 90 and rear-top attachment member 92. Note that each of these members 90, 92 have a row of holes 94, 96, respectively, that are positioned and spaced according to industry standard spacing utilized in commercial shelving systems. The shelving surfaces in commercial systems are perforated with holes of equal spacing (not shown), and the arrangement of holes 94, 96 facilitates convenient attachment of the lock box 2 to such commercial shelving systems. FIG. 5 also illustrates the depth adjustment telescopic tubing pairs 100, 104 and 98, 102, as illustrated.

Figure 7:
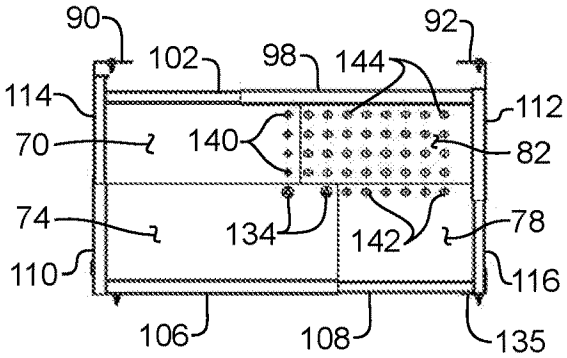
FIG. 7 is a side view drawing of a display shelf lock box in a fully expanded configuration according to an illustrative embodiment of the present invention.
Figure 6:
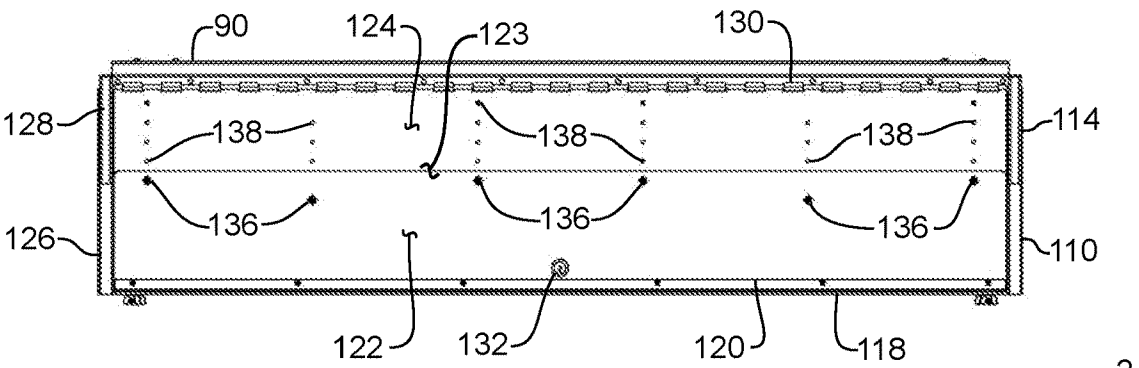
FIG. 6 is a front view drawing of a display shelf lock box in a fully expanded configuration according to an illustrative embodiment of the present invention.

Reference is directed to FIG. 6 and FIG. 7, which are a front view drawing and a right-side view drawing, respectively, of a display shelf lock box 2 in a fully expanded configuration according to an illustrative embodiment of the present invention. In FIG. 6, several framing members are visible, including the front-right and front-left telescopic tubes 110, 114 and 126, 128, respectively. The front-top attachment member 90 is also presented, and a portion of the front-bottom cross member tube 118 is also visible. Along the top of the front is a hinge 130 that is engaged with an upper portion 124 of the door 123. The upper portion 124 is overlappingly engaged with a lower portion 122, which arrangement enables the height adjustment of the door 123. Both door portions 122, 124 are fabricated from clear plastic, such as Lexan®, PVC, polycarbonate, or the like, as are known to those skilled in the art. The upper portion 124 is perforated with plural columns of holes 138, as illustrated. The lower portion 122 has plural threaded inserts 136 that are aligned with the plural columns of holes 138. Threaded fasteners (not shown) are inserted through selected ones of the columns of holes, from the inside, and engage corresponding threaded inserts 136. With this arrangement, the user is able to adjust the height of the door 123 to match the desired height of the lock box 2, depending on the shelf spacing of the the shelving systems (not shown) into which the lock box 2 is installed. The lock 132 is visible in this view, as well as the steel reinforcing member 120 along the bottom of lower portion 122 of the door 123. Note that in this disclosure, the use of the words fasteners and holes are used somewhat interchangeably. For example, two surface that each have holes formed therethrough may be joined together using screws. While the screw is technically a fastener, the presence of the holes are a means for fastening, and therefore a fastener in their own right.

The right-side view, FIG. 7, illustrates further details of the height and depth adjustment features. Note that the front-right telescopic tubes 110, 114 are fully extended, as are the rear-right telescopic tubes 112, 116. Similarly, the top-right 98, 102 and bottom-right 106, 108 telescopic tubes are also fully extended, which define the maximum height and depth, respectively, of the lock box 2. The arrangement of the four right-side quarter-panels 70, 74, 78, and 82 are also of note in this view. The rear-top quarter-panel 82 is perforated with a grid of fastener holes 144, arranged in plural columns and plural rows. The rear-bottom quarter-panel is perforated with a row of fastener holes 142, and the front-top quarter panel 70 is perforated with a column of fastener holes 140. Finally, the front-bottom quarter panel 74 is perforated with two fastener holes 134, having secure fasteners placed therethrough. By utilizing a consistent spacing of all these holes, such as one-inch spacing, the user is able to adjust the location of the two holes 134 in the front-bottom quarter-panel 74 with respect to the remaining quarter-panel holes 140, 144, and 142, such that the height and depth of the lock-box is selected and maintained. The left side (not shown) of the lock box 2 is similarly arranged for adjustability.

Figure 9:
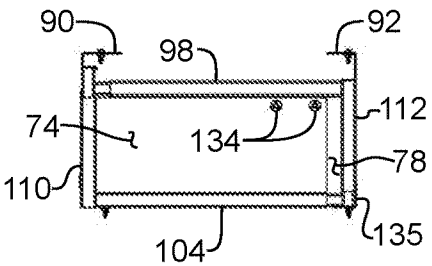
FIG. 9 is a side view drawing of a display shelf lock box in a fully compressed configuration according to an illustrative embodiment of the present invention.
Figure 8:
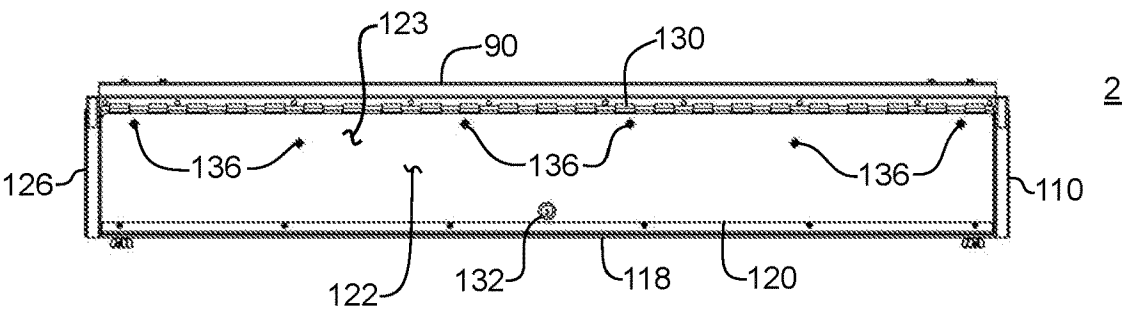
FIG. 8 is a front view drawing of a display shelf lock box in a fully compressed configuration according to an illustrative embodiment of the present invention.

Reference is directed to FIG. 8 and FIG. 9, which are a front view drawing and a right-side view drawing, respectively, of a display shelf lock box 2 in a fully compressed configuration according to an illustrative embodiment of the present invention. In FIG. 8, it should be noted that only the larger telescopic tubes, 126 on the left, and 110 on the right, are visible because the lock-box is fully compressed, and the smaller size tube are concealed inside the larger size tubes. Also, only the lower portion 122 of the door 123 is visible because it fully covers the upper portion (item 124 in FIG. 6). The row of threaded inserts 136 on the lower portion 122 are illustrated. The lock 132 is visible in this view, as well as the steel reinforcing member 120 along the bottom, or lower, portion 122 of the door 123.

In the right side view of FIG. 9, the larger telescopic tubes, 110 in the front and 112 in the rear, as well as 98 on the top and 104 on the bottom, are visible, and substantially obscure the smaller tubes therein. The front-top 90 and rear-top 92 attachment members are also visible. Note in this view that front-bottom right quarter-panel 74 obscures the other side-panels, except that a small portion of the rear-bottom right quarter-panel 78 can be seen. The secure fasteners 134 bind all the side-panels together and fix the height and depth of the lock box 2.

Figure 10:
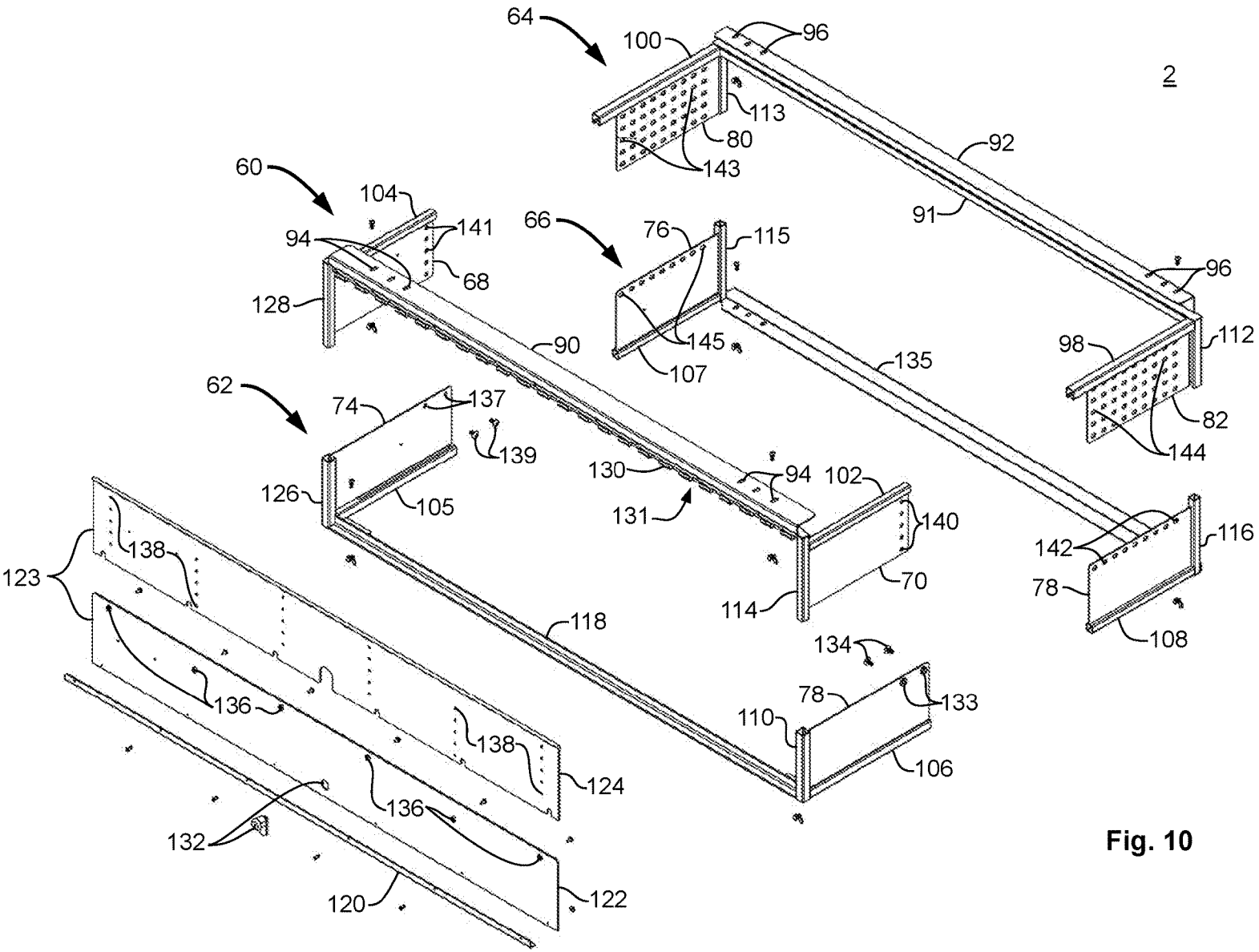
FIG. 10 is an exploded isometric view drawing of a display shelf lock box showing four quadrantal sub-frames and door components according to an illustrative embodiment of the present invention.

Reference is directed to FIG. 10, which is an exploded isometric view drawing of a display shelf lock box 2 showing four quadrantal sub-frames 60, 62, 64, and 66, and door 123 components according to an illustrative embodiment of the present invention. The door 123 is comprised of the two clear plastic panel portions 124 and 122, steel reinforcing member 120, which is a steel angle bracket, and lock and lock hole 132. The aforementioned four quadrantal sub-frames include the front-top quadrant 60, the front-bottom quadrant 62, the rear-top quadrant 64, and the rear-bottom quadrant 66. The front-top quadrant frame 60 includes the front-top attachment member 90, which obscures a front-top cross member 131 from view, and hinge 130. At the left and right ends of these members, are telescope tubing members 104 and 128 on the left, and 102, 114 on the right. These tubes support front-top left quarter-panel 68 and front-top right quarter-panel 70, as illustrated. Holes 94 in the front-top attachment member are presented, as well as the column of holes 141, 140 in left and right quarter-panels 74, 78, respectively are also presented.

Continuing in FIG. 10, the front-bottom quadrant frame 62 includes a front-bottom cross-member 118, which is a bent-metal shape, connects telescope tubing members 105, 126 on the left, and 106, 110 on the right. These tubes support front-bottom left quarter-panel 74 and front-bottom right quarter-panel 106, as illustrated. Holes 137, 133 in left and right quarter-panels 74, 78, respectively, are also presented, as well as the corresponding secure fasteners 139, 134. The rear-top quadrant 64 includes a rear-top cross-member 91, which is a metal tube, and rear-top attachment member 92 with its mounting holes 96. The cross member 91 connects telescope tubing members 100, 113 on the left, and 98, 112 on the right. These tubes support rear-top left quarter-panel 80 and rear-top right quarter-panel 82, as illustrated. The grid pattern of holes 143, 144 in left and right quarter-panels 80, 82, respectively, are also presented in this view. The rear-bottom quadrant 66 includes a rear-bottom cross-member 135, which is a bent metal shape. The cross member 135 connects telescope tubing members 107, 115 on the left, and 108, 116 on the right. These tubes support rear-bottom left quarter-panel 76 and rear-bottom right quarter-panel 78, as illustrated. The row of holes 145, 142 in left and right quarter-panels 76, 78, respectively, are also presented in this view. In the illustrative embodiment, an optional top cover is available for when the lock box 2 is positioned on a top shelf of a gondola. Standard widths are 36" and 48" industry standard shelf sizes, although other widths are contemplated.

Figure 11:
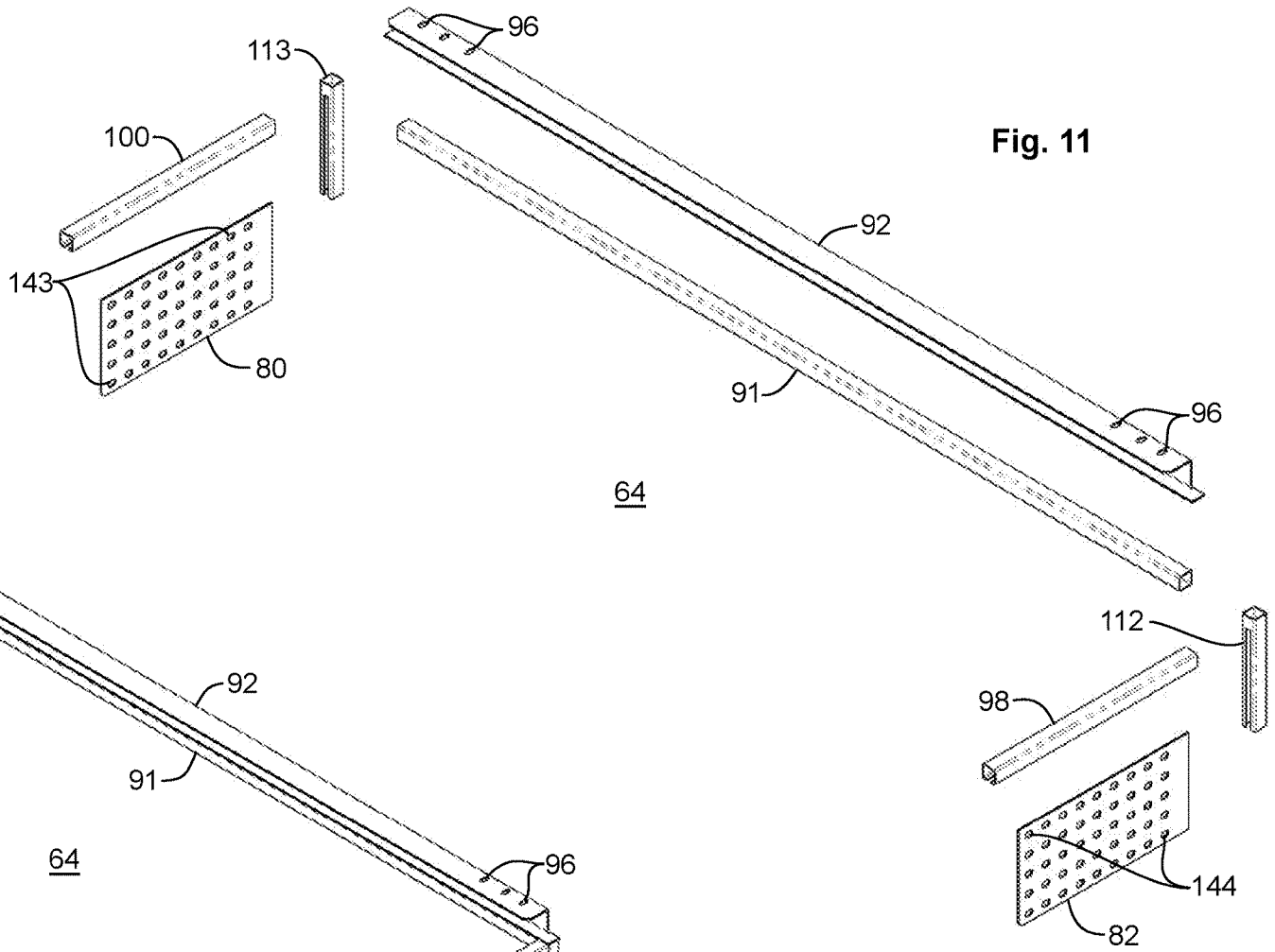
FIG. 11 is an exploded isometric view drawing of a rear-top quadrantal sub-frame of a display shelf lock box according to an illustrative embodiment of the present invention.
Figure 12:
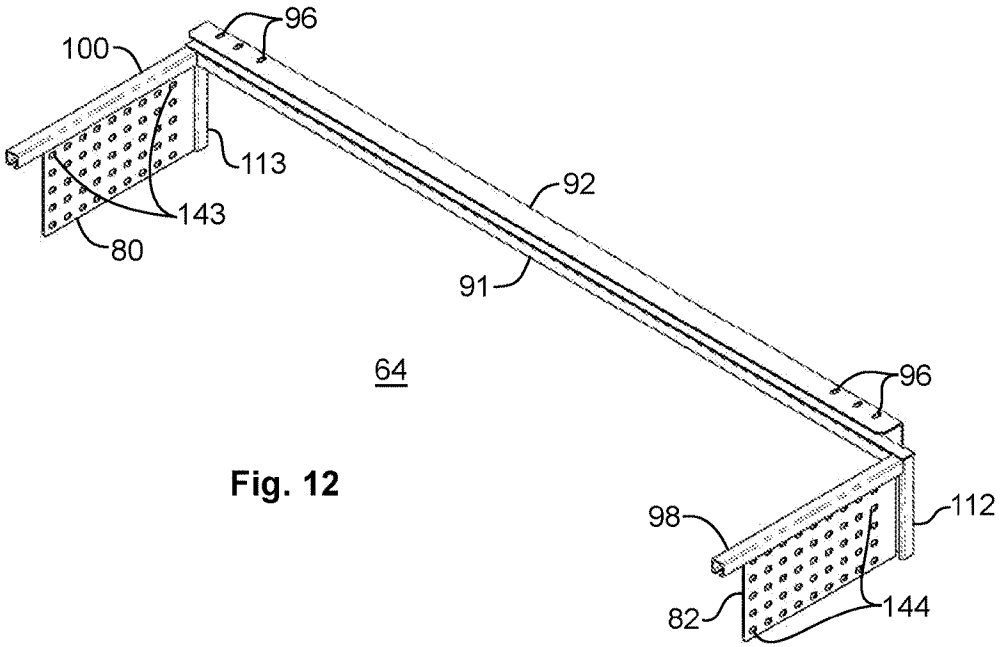
FIG. 12 is an isometric view drawing of a rear-top quadrantal sub-frame of a display shelf lock box according to an illustrative embodiment of the present invention.

Reference is directed to FIG. 11 and FIG. 12, which are an exploded isometric view drawing and an isometric view drawing, respectively, of a rear-top quadrantal sub-frame 64 of a display shelf lock box according to an illustrative embodiment of the present invention. The exploded view provides further visual cues as to the structure and assembly of the quadrantal sub-frame 64. Note that in the illustrative embodiment, the assembly 64 is welded together, such as by MIG or TIG welding techniques. The cross member 91 is a steel tubing section, which is welded together with the telescopic tubing sections 113, 100, 98, and 112, as illustrated. The telescopic tubing sections are slotted to accept the left quarter-panel 80 and right quarter-panel 82, as illustrated. The quarter-panels 80, 82 are welded in place, and positioned side-to-side with consideration for the overlapping engagement requirements discussed hereinbefore. The rear-top attachment member 92, which is a bent-metal member, is welded to the cross member 91. The grids of holes 143, 144 in the left and right quarter-panels 80, 82, respectively are also presented in this drawing figure.

Figure 13:
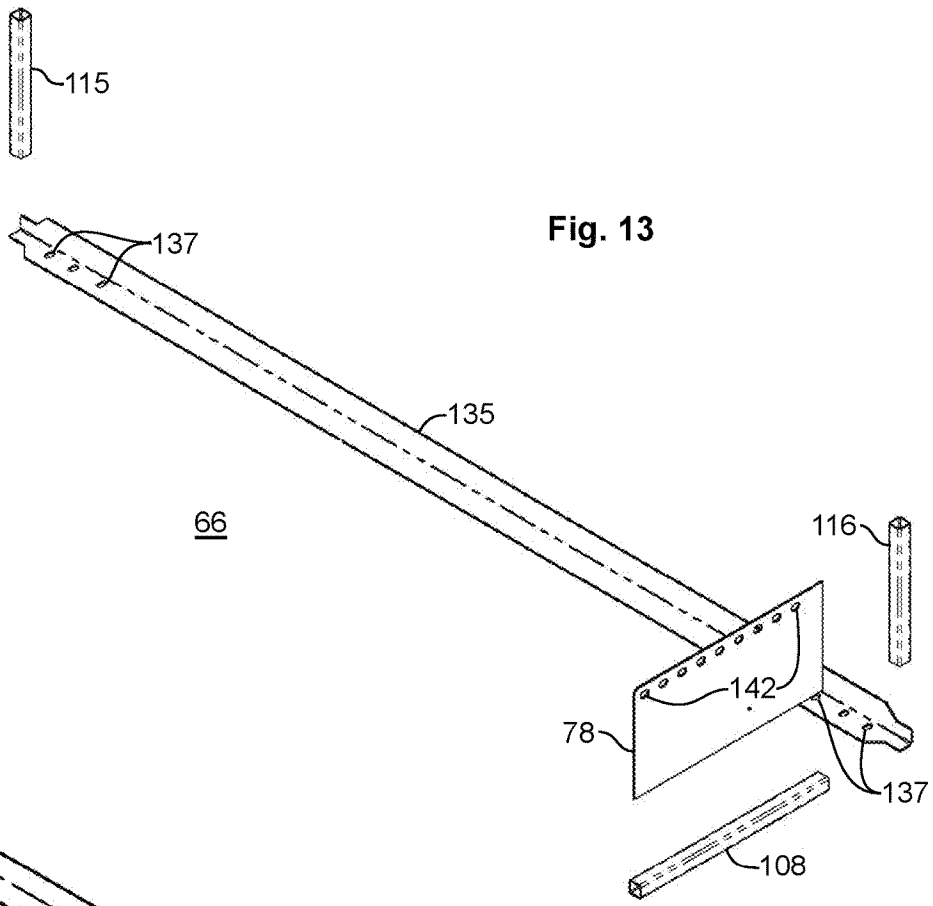
FIG. 13 is an exploded isometric view drawing of a rear-bottom quadrantal sub-frame of a display shelf lock box according to an illustrative embodiment of the present invention.
Figure 14:
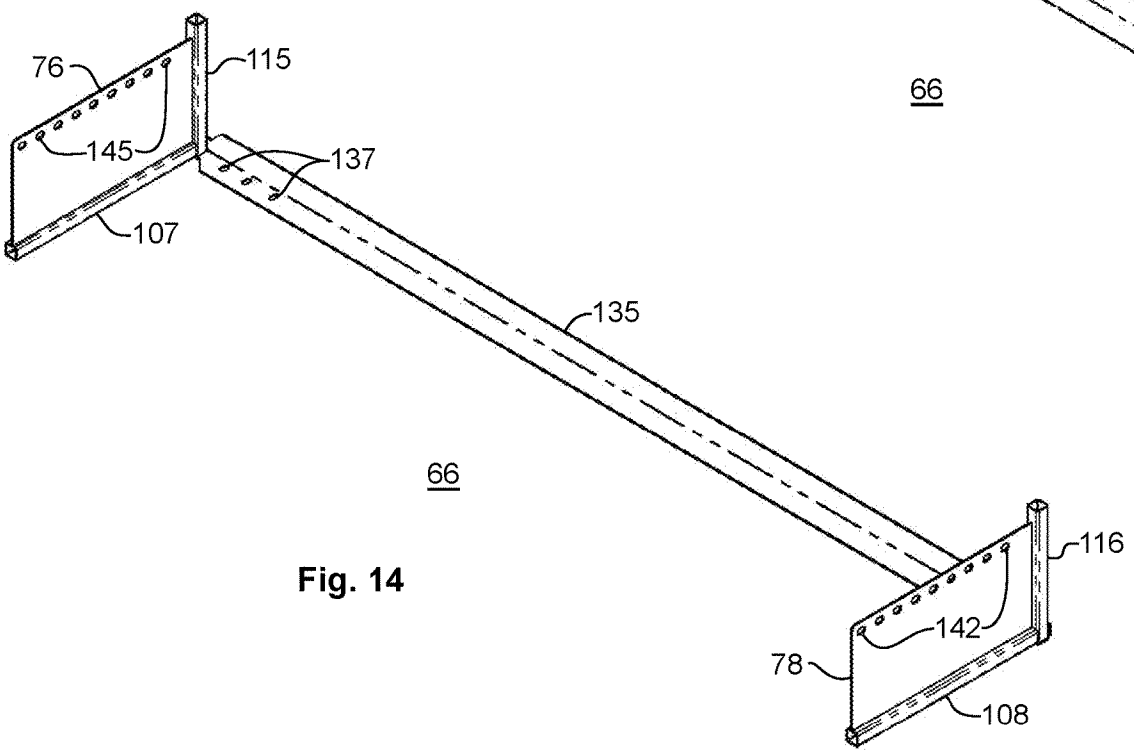
FIG. 14 is an isometric view drawing of a rear-bottom quadrantal sub-frame of a display shelf lock box according to an illustrative embodiment of the present invention.

Reference is directed to FIG. 13 and FIG. 14, which are an exploded isometric view drawing and an isometric view drawing, respectively, of a rear-bottom quadrantal sub-frame 66 of a display shelf lock box according to an illustrative embodiment of the present invention. The exploded view provides further visual cues as to the structure and assembly of the quadrantal sub-frame 66. Note that in the illustrative embodiment, the assembly 66 is welded together, such as by MIG or TIG welding techniques. The cross member 135 is a bent steel member, which is welded together with the telescopic tubing sections 107, 155, 108, and 116, as illustrated. The quarter-panels 76, 78 are welded in place, and positioned side-to-side with consideration for the overlapping engagement requirements discussed hereinbefore. The rows of holes 145, 144 in the left and right quarter-panels 76, 78, respectively are also presented in this drawing figure. Note that the rear bottom cross member 135 has holes formed therethrough for attachment to an adjacent shelf surface (not shown).

Figure 15:
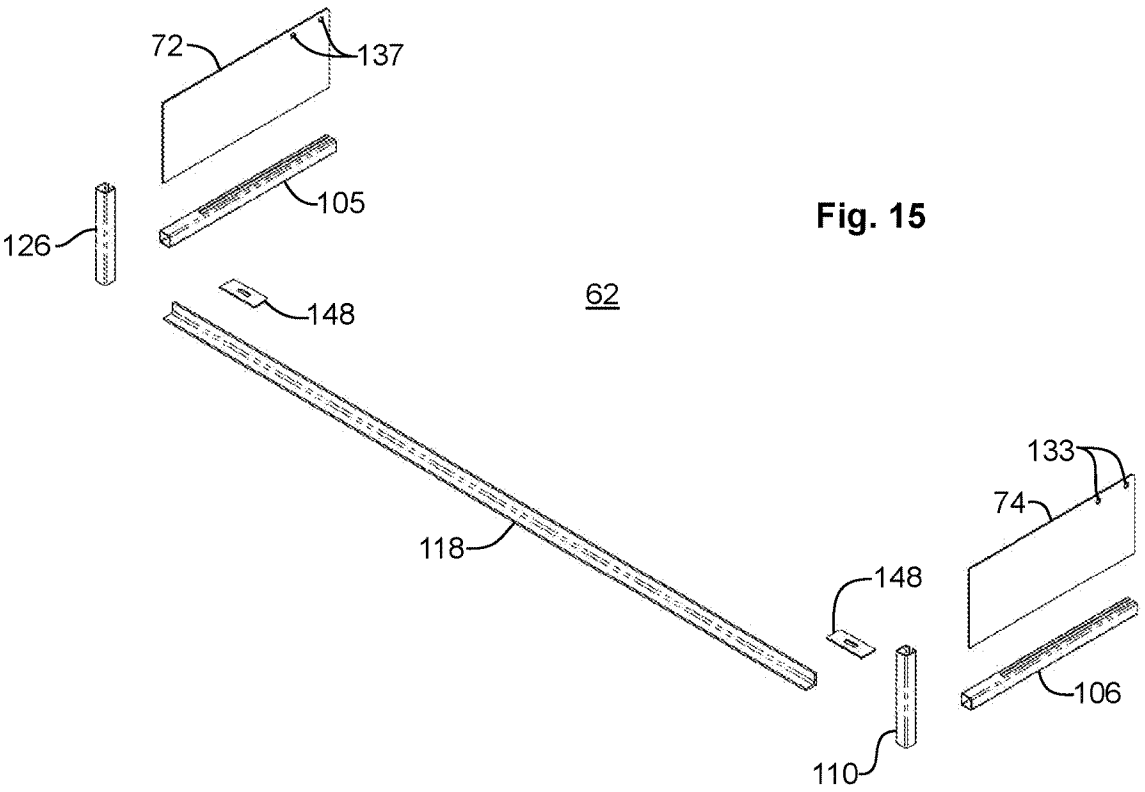
FIG. 15 is an exploded isometric view drawing of a front-bottom quadrantal sub-frame of a display shelf lock box according to an illustrative embodiment of the present invention.
Figure 16:
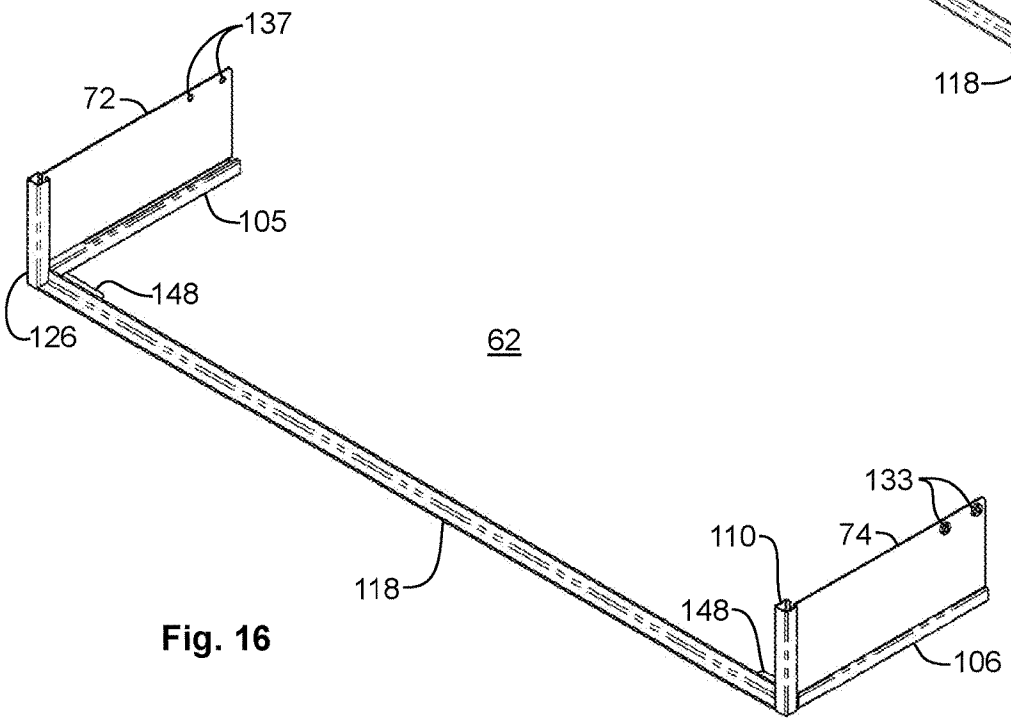
FIG. 16 is an isometric view drawing of a front-bottom quadrantal sub-frame of a display shelf lock box according to an illustrative embodiment of the present invention.

Reference is directed to FIG. 15 and FIG. 16, which are an exploded isometric view drawing and an isometric view drawing, respectively, of a front-bottom quadrantal sub-frame 62 of a display shelf lock box according to an illustrative embodiment of the present invention. The exploded view provides further visual cues as to the structure and assembly of the quadrantal sub-frame 62. Note that in the illustrative embodiment, the assembly 62 is welded together, such as by MIG or TIG welding techniques. The cross member 118 is a steel tubing member, which is welded together with the telescopic tubing sections 105, 126, 106, and 110, as illustrated. The quarter-panels 72, 74 are welded in place, and positioned side-to-side with consideration for the overlapping engagement requirements discussed hereinbefore. The security screw holes 137, 133 in the left and right quarter-panels 72, 74, respectively are also presented in this drawing figure. Note the location of front-bottom attachment members 148, which are welded to the cross member 118. The attachment members 148 facilitate connection to a host display shelf (not shown).

Figure 17:
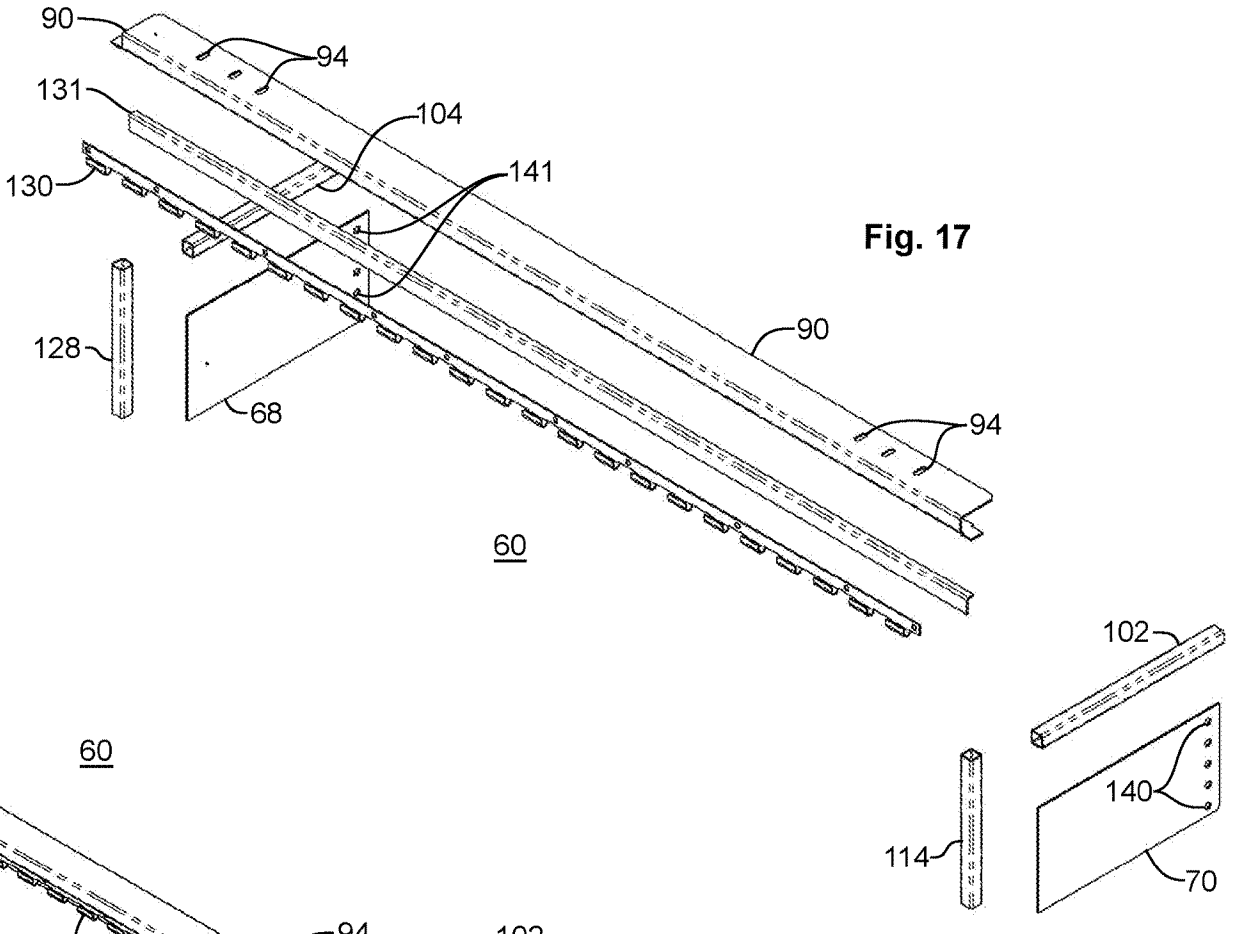
FIG. 17 is an exploded isometric view drawing of a front-top quadrantal sub-frame of a display shelf lock box according to an illustrative embodiment of the present invention.
Figure 18:
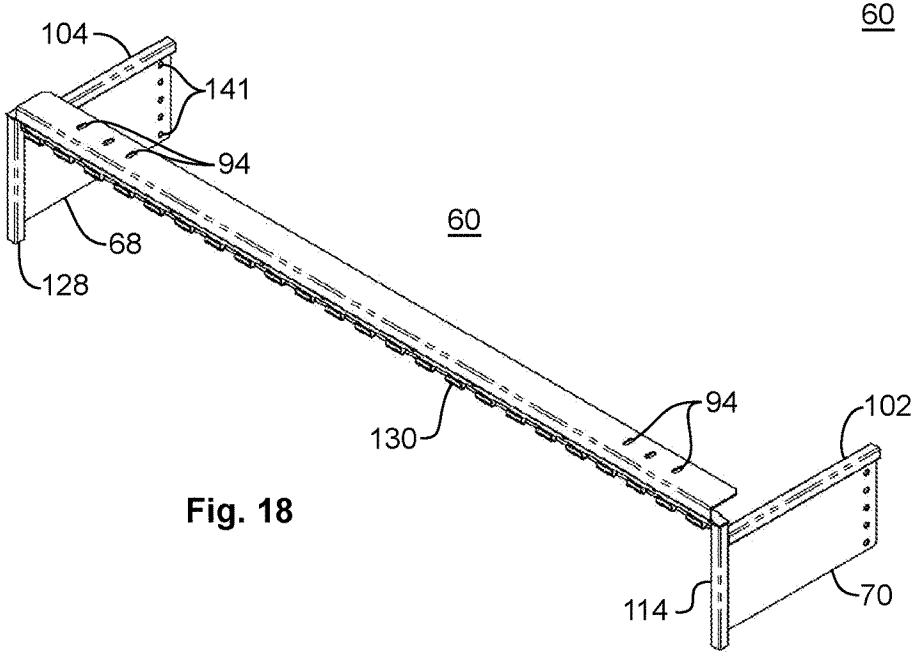
FIG. 18 is an isometric view drawing of a front-top quadrantal sub-frame of a display shelf lock box according to an illustrative embodiment of the present invention.

Reference is directed to FIG. 17 and FIG. 18, which are an exploded isometric view drawing and an isometric view drawing, respectively, of a front-top quadrantal sub-frame 60 of a display shelf lock box according to an illustrative embodiment of the present invention. The exploded view provides further visual cues as to the structure and assembly of the quadrantal sub-frame 60. Note that in the illustrative embodiment, the assembly 60 is welded together, such as by MIG or TIG welding techniques. The cross member 131 is a bent steel member, which is welded together with the telescopic tubing sections 104, 128, 102, and 114, as illustrated. The quarter-panels 68, 70 are welded in place, and positioned side-to-side with consideration for the overlapping engagement requirements discussed hereinbefore. The columns screw holes 141, 140 in the left and right quarter-panels 68, 70, respectively are also presented in this drawing figure. Note the location of front-top attachment member 90, which is welded to the cross member 131, and includes mounting holes 94 to facilitate connection to a host upper display shelf (not shown). Note hinge member 130, which may be welded, bolted, or riveted to the cross member 131. The hinge 130 will be more fully discussed hereinafter.

Figure 19:
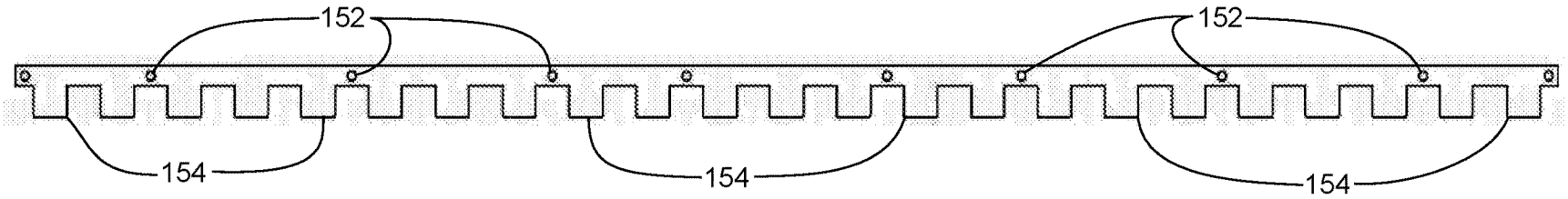
FIG. 19 is a drawing of a hinge in a display shelf lock box according to an illustrative embodiment of the present invention.

Reference is directed to FIG. 19, which is a drawing of a hinge 130 in a display shelf lock box according to an illustrative embodiment of the present invention. The hinge 130 in this view is a flat-pattern for steel fabrication, and requires a further step of bending the plural tangs 154 into a J-shape. Plural attachment holes 152 are proved to facilitate connection of the hinge 130 the the lock box (not shown).

Figure 20:
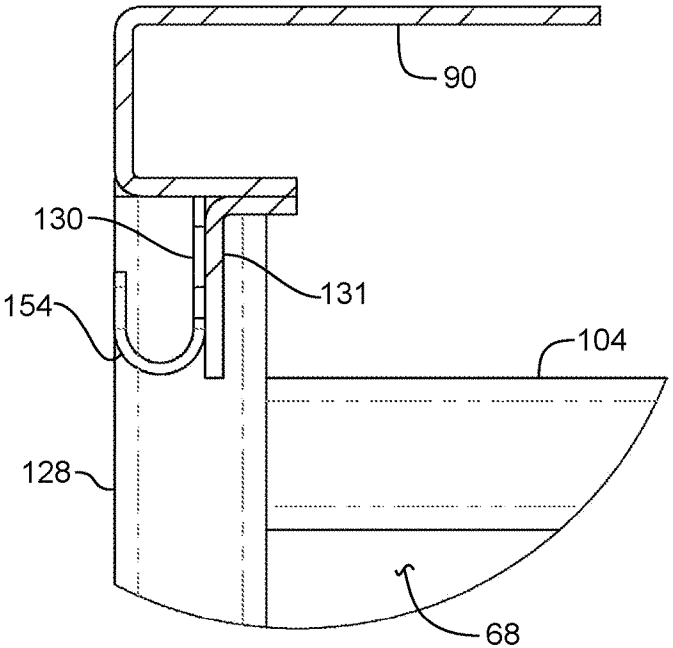
FIG. 20 is a section view drawing of a hinge in a display shelf lock box according to an illustrative embodiment of the present invention.

Reference is directed to FIG. 20, which is a section view drawing of a hinge 130 and related support components in a display shelf lock box according to an illustrative embodiment of the present invention. This is a section view through the front-top cross member 131, the hinge 103, and the front-top attachment member 90, showing their physical alignment. Telescopic tubes 104 and 128 can be seen, as well as a portion of front-top left quarter-panel 68. Note that the hinge 130 has tangs 154 bent into a J-shape, prior to assembly. These tangs 154 hingedly engage corresponding slots in the door (not shown).

Figure 22:
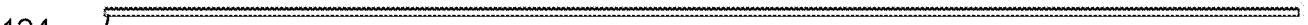
FIG. 22 is a top view drawing of an upper door panel in a display shelf lock box according to an illustrative embodiment of the present invention.
Figure 21:
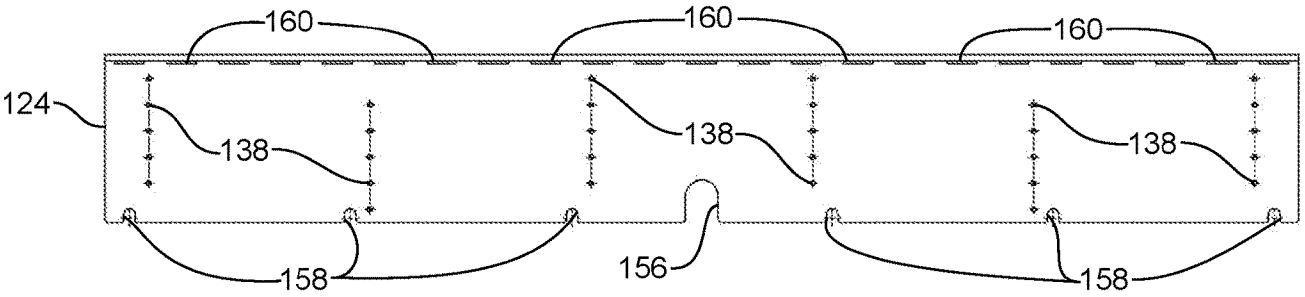
FIG. 21 is a front view drawing of an upper door panel in a display shelf lock box according to an illustrative embodiment of the present invention.
Figure 23:
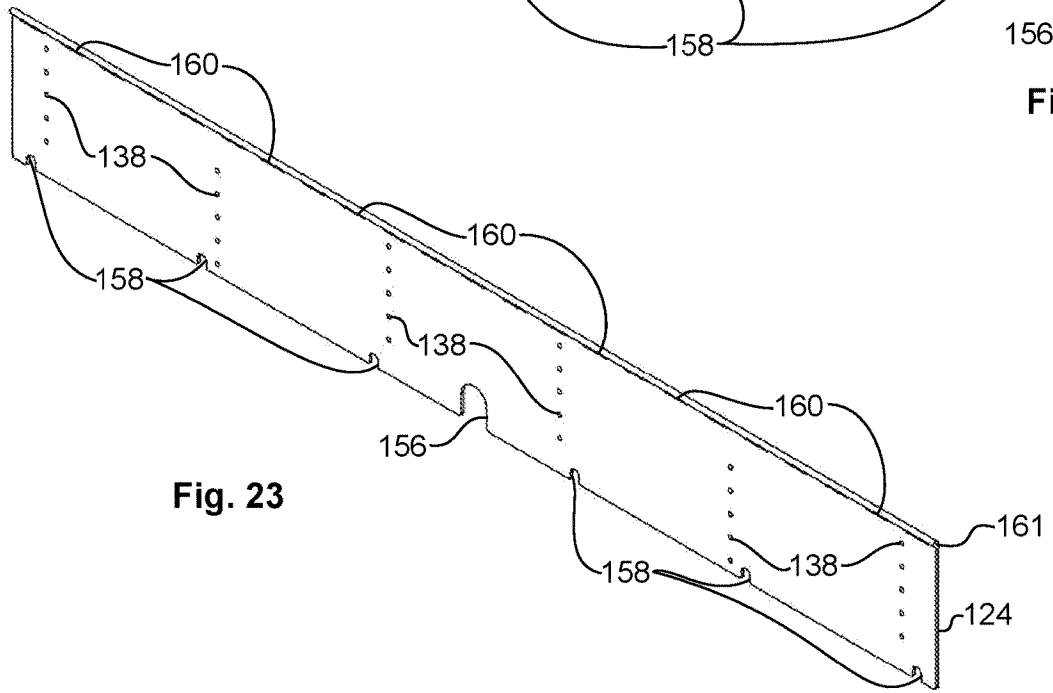
FIG. 23 is an isometric view drawing of an upper door panel in a display shelf lock box according to an illustrative embodiment of the present invention.

Reference is directed to FIG. 21, FIG. 22, and FIG. 23, which are a front view drawing, a top view drawing, and an isometric view drawing, respectively, of an upper door panel 124 in a display shelf lock box according to an illustrative embodiment of the present invention. The upper portion 124 is fabricated from polycarbonate in the illustrative embodiment. It is a planar structure with a reinforcing bead 161 along its upper edge. Plural slots 160 a formed through the panel 124 just below the reinforcing rib 161, which serve to hingedly engage the tangs on the hinge (item 154 in FIG. 20). Plural columns of holes 138 are formed through the panel 124 to facilitate adjustable connection to the lower door portion (not shown). Plural clearance slots 158 are scalloped out of the lower edge to clear other fasteners in the assembly. A lock cut-out 156 is also scalloped out of the lower edge to provide clearance for the lock (not shown) while the lock box (not shown) is at the collapsed configuration.

Figure 25:
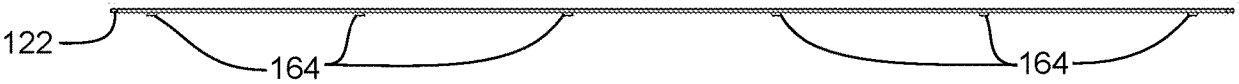
FIG. 25 is a top view drawing of a lower door panel in a display shelf lock box according to an illustrative embodiment of the present invention.
Figure 24:
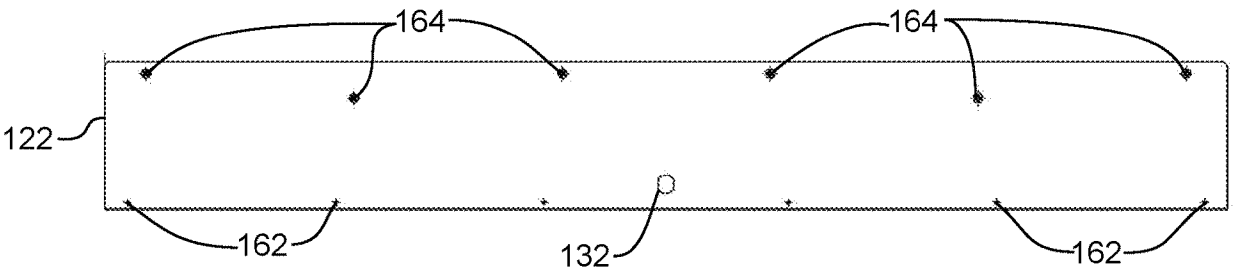
FIG. 24 is a front view drawing of a lower door panel in a display shelf lock box according to an illustrative embodiment of the present invention.
Figure 26:
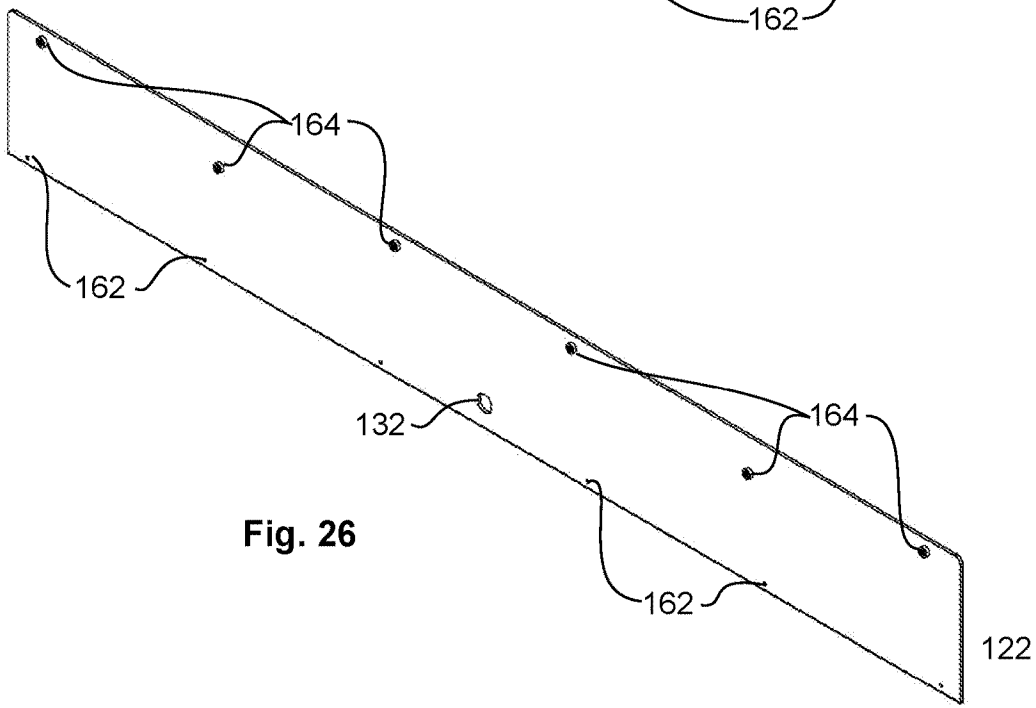
FIG. 26 is an isometric view drawing of a lower door panel in a display shelf lock box according to an illustrative embodiment of the present invention.

Reference is directed to FIG. 24, FIG. 25, and FIG. 26, which are a front view drawing, a top view drawing, and an isometric view drawing, respectively, of a lower door panel 122 in a display shelf lock box according to an illustrative embodiment of the present invention. The lower portion 122 is fabricated from planar polycarbonate in the illustrative embodiment. Plural threaded inserts 164 are attached and aligned to facilitate connection with the columns of holes (items 138 in FIG. 23) using screws (not shown). This arrangement perfects the adjustable height of the door. Additional holes 162 are provided adjacent the bottom edge for connection of the reinforcing member (item 120 in FIG. 10). An additional hole 132 is provided from insertion of a lock.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A lock box useful to secure products in a display shelving system that includes a first shelf surface, the lock box comprising:

first, second, third, and fourth quadrantal sub-frames combinable into a frame unit having a rectangular cuboidal form with a front face, a rear face, a top face, a bottom face, a left face and a right face; and wherein said first, second, third, and fourth quadrantal sub-frames include corresponding first, second, third, and fourth left-face quarter-panels respectively, and corresponding first, second, third, and fourth right-face quarter-panels respectively; wherein the left-face quarter-panels adjustably and overlappingly engage one another to form a corresponding size adjustable left sidewall along said left face of said frame unit, wherein the right-face quarter-panels adjustably and overlappingly engage one another to form a corresponding size adjustable right sidewall along said right face of said frame unit, to thereby enable selectable adjustment of the height and depth of said frame unit;

a hinge coupled along said front face of said frame unit; a door comprised of a first portion engaged with said hinge and a second portion adjustably and overlappingly engaged with said first portion to thereby enable selectable adjustment of a height of said door to fit said front-face of said frame unit, and a lock mechanism disposed between said door and said frame unit to selectively secure said door in a closed position, and wherein said frame unit comprises a first attachment member that secures said frame unit to the first shelf surface.

2. The lock box of claim 1, wherein said bottom face of said frame unit is open, and wherein:

said first attachment member secures said frame unit in place such that the first shelf surface encloses said bottom face of said frame unit.

3. The lock box of claim 1, wherein the display shelving system includes a back wall surface adjacent the first shelf surface, and wherein said rear face of said frame unit is open, and wherein:

said first attachment member secures said frame unit in place such that the back wall surface encloses said rear face of said frame unit.

4. The lock box of claim 1, wherein the display shelving system includes a second shelf surface located above the first shelf surface, and wherein said top face of said frame unit is open, and wherein:

said first attachment member secures said frame unit in place such that the second shelf surface encloses said top face of said frame unit.

5. The lock box of claim 1, wherein the display shelving system includes a second shelf surface located above the first shelf surface, and further comprising:

a second attachment member that secures said frame unit to the second shelf surface.

6. The lock box of claim 1, and wherein:

at least a first one of said first, second, third, and fourth left-face quarter-panels comprises a first vertical column of fastener holes, and wherein at least a second one of said first, second, third, and fourth left-face quarter-panels comprises at least a first fastener hole aligned with one of said first vertical column of fastener holes respectively, thereby enabling adjustment of the height of said frame unit;

at least a first one of said first, second, third, and fourth right-face quarter-panels comprises a second vertical column of fastener holes, and wherein at least a second one of said first, second, third, and fourth right-face quarter-panels comprises at least a second fastener hole aligned with one of said second vertical column of fastener holes respectively, thereby enabling adjustment of the height of said frame unit.

7. The lock box of claim 6, further comprising a first fastener selectively disposed through said one of said first vertical column of fastener holes and said first fastener hole respectively;

a second fastener selectively disposed through said one of said second vertical column of fastener holes and said second fastener hole respectively.

8. The lock box of claim 1, and wherein:

at least a first one of said first, second, third, and fourth left-face quarter-panels comprises a first horizontal row of fastener holes, and wherein at least a second one of said first, second, third, and fourth left-face quarter-panels comprises at least a first fastener hole aligned with one of said first horizontal row of fastener holes, thereby enabling adjustment of the depth of said frame unit;

at least a first one of said first, second, third, and fourth right-face quarter-panels comprises a second horizontal row fastener holes, and wherein at least a second one of said first, second, third, and fourth right-face quarter-panels comprises at least a second fastener hole aligned with one of said second horizontal row of fastener holes respectively, thereby enabling adjustment of the depth of said frame unit.

9. The lock box of claim 8, further comprising a first fastener selectively disposed through said one of said first horizontal row of fastener holes and said first fastener hole respectively;

a second fastener selectively disposed through said one of said second horizontal row of fastener holes and said second fastener hole respectively.

10. The lock box of claim 1, and wherein:

one of said first portion and said second portion of said door comprises a vertical column of fastener holes, and wherein one of said first portion and said second portion of said door comprises a threaded insert aligned to selectively engage one of said vertical column of fastener holes, thereby enabling adjustment of the height of said door.

11. The lock box of claim 10, and wherein:

said first portion of said door comprises the vertical column of fastener holes, and wherein said second portion of said door comprises the threaded insert, wherein a screw is inserted within the threaded insert and passes through a said one of said vertical column of fastener holes.

12. The lock box of claim 1, and wherein:

said lock mechanism is fixed to said second portion of said door, wherein said lock mechanism selectively engages said frame unit, thereby securing said door in said closed position.

13. The lock box of claim 1, and wherein said hinge comprises:

a row of J-shaped tangs extending from said frame unit adjacent said front face, and wherein said first portion of said door comprises a row of slots that correspondingly engage said row of J-shaped tangs to thereby facilitate hinged movement of said first portion of said door with respect to said frame unit.

14. The lock box of claim 1, and wherein:

said first, second, third, and fourth quadrantal sub-frames comprise telescopically cooperative frame tubing members disposed adjacent said first, second, third, and fourth left-face quarter-panels, and said first, second, third, and fourth right-face quarter-panels, to thereby facilitate said selectable adjustment of the height and depth of said frame unit.

15. The lock box of claim 1, wherein the first shelf surface is perforated with a predetermined first array of holes, and wherein:

said first attachment member is an angle bracket fixed to said frame unit, and having a second array of holes formed therethrough and arranged to comport with the predetermined first array of holes for securing said frame unit to the first shelf surface with threaded fasteners.

16. The lock box of claim 5, wherein the second shelf surface is perforated with a predetermined first array of holes, and wherein:

said second attachment member is an angle bracket fixed to said frame unit, and having a second array of holes formed therethrough and arranged to comport with the predetermined first array of holes for securing said frame unit to the second shelf surface with threaded fasteners.

* * * * *